US010563899B2

(12) United States Patent
Wilson

(10) Patent No.: US 10,563,899 B2
(45) Date of Patent: Feb. 18, 2020

(54) REFRIGERATOR WITH TARGETED COOLING ZONE

(71) Applicant: Midea Group Co., Ltd., Foshan (CN)

(72) Inventor: Mark Wilson, Simpsonville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 0 days.

(21) Appl. No.: 15/269,385

(22) Filed: Sep. 19, 2016

(65) Prior Publication Data

US 2018/0080702 A1 Mar. 22, 2018

(51) Int. Cl.

| | |
|---|---|
| ***F25D 17/06*** | (2006.01) |
| ***F25D 11/02*** | (2006.01) |
| ***F25D 17/04*** | (2006.01) |
| ***F25D 29/00*** | (2006.01) |

(52) U.S. Cl.

CPC ..... *F25D 17/062* (2013.01); *F25D 17/045* (2013.01); *F25D 17/065* (2013.01); *F25D 29/005* (2013.01); *F25B 2600/112* (2013.01); *F25D 11/02* (2013.01); *F25D 2317/06* (2013.01); *F25D 2317/061* (2013.01); *F25D 2317/063* (2013.01); *F25D 2317/0672* (2013.01); *F25D 2400/06* (2013.01); *F25D 2400/28* (2013.01); *F25D 2700/06* (2013.01); *F25D 2700/121* (2013.01); *F25D 2700/16* (2013.01)

(58) Field of Classification Search

CPC ..... F25D 11/02; F25D 17/065; F25D 27/005; F25D 2700/06; F25D 2700/121; F25D 2700/12; F25D 2700/123; F25D 2317/06; F25D 2317/061; F25D 2317/063; F25D 2317/0672

See application file for complete search history.

(56) References Cited

U.S. PATENT DOCUMENTS

| | | | | |
|---|---|---|---|---|
| 2,403,164 A | | 7/1946 | Ahrens | |
| 4,368,622 A | | 1/1983 | Brooks | |
| 6,000,232 A | * | 12/1999 | Witten-Hannah ..... | F25D 17/065 165/208 |
| 6,474,094 B2 | | 11/2002 | Kim | |
| 6,705,099 B2 | | 3/2004 | Cho et al. | |
| 6,715,306 B2 | | 4/2004 | Cho et al. | |

(Continued)

FOREIGN PATENT DOCUMENTS

| | | |
|---|---|---|
| BR | 0801889 | 5/2011 |
| CN | 1169184 A | 12/1997 |

(Continued)

OTHER PUBLICATIONS

U.S. Patent and Trademark Office, Office Action issued in related U.S. Appl. No. 15/269,334 dated Nov. 1, 2017.

(Continued)

*Primary Examiner* — Edward F Landrum
*Assistant Examiner* — Daniel C Comings
(74) *Attorney, Agent, or Firm* — Middleton Reutlinger

(57) ABSTRACT

A refrigerator appliance and method of dispensing cooling air towards a targeted cooling zone for cooling objects within a fresh-food compartment. The dispensing of cooling air may be based in part on the temperature of the object within the targeted cooling zone.

21 Claims, 6 Drawing Sheets

(56) References Cited

U.S. PATENT DOCUMENTS

| | | | | |
|---|---|---|---|---|
| 6,718,780 | B2 * | 4/2004 | Cho | F25D 17/045 62/186 |
| 6,779,357 | B1 | 8/2004 | Fann | |
| 6,802,369 | B2 | 10/2004 | Zentner et al. | |
| 7,506,763 | B2 | 3/2009 | Hatcher | |
| 7,866,170 | B2 | 1/2011 | Boer et al. | |
| 8,464,544 | B2 * | 6/2013 | Shin | F25D 11/02 62/157 |
| 9,255,730 | B2 | 2/2016 | Lee | |
| 2003/0038571 | A1 | 2/2003 | Obrock et al. | |
| 2003/0131541 | A1 | 7/2003 | Lee et al. | |
| 2004/0107726 | A1 | 6/2004 | Kim et al. | |
| 2007/0268682 | A1 | 11/2007 | Kim et al. | |
| 2008/0047282 | A1 | 2/2008 | Bodin et al. | |
| 2012/0255321 | A1 | 10/2012 | Cho et al. | |
| 2013/0015753 | A1 * | 1/2013 | Son | F25D 29/00 312/405 |
| 2013/0160473 | A1 | 6/2013 | Hu et al. | |
| 2013/0264928 | A1 | 10/2013 | Hong et al. | |
| 2016/0146528 | A1 | 5/2016 | Yoon et al. | |
| 2017/0219278 | A1 * | 8/2017 | Hui | F25D 29/00 |

FOREIGN PATENT DOCUMENTS

| | | | |
|---|---|---|---|
| CN | 1206820 | A | 2/1999 |
| CN | 1209535 | A | 3/1999 |
| CN | 2705759 | | 6/2005 |
| CN | 1910415 | A | 2/2007 |
| CN | 101377375 | | 3/2009 |
| CN | 101730826 | A | 6/2010 |
| CN | 202304237 | | 7/2012 |
| CN | 103629877 | A | 3/2014 |
| CN | 105066554 | A | 11/2015 |
| CN | 105066563 | A | 11/2015 |
| CN | 105806010 | A | 7/2016 |
| DE | 102012201107 | A1 | 8/2013 |
| EP | 0158297 | A2 | 10/1985 |
| EP | 1887298 | A1 | 2/2008 |
| JP | 0611231 | | 1/1994 |
| JP | 9303941 | | 11/1997 |
| JP | 10009744 | | 1/1998 |
| JP | 10009755 | | 1/1998 |
| JP | 10026457 | | 1/1998 |
| JP | 10038444 | | 2/1998 |
| JP | 10153372 | | 6/1998 |
| JP | 2002031463 | A | 1/2002 |
| JP | 4914172 | | 5/2008 |
| KR | 20100085242 | A | 7/2010 |
| WO | 11124449 | | 10/2011 |

OTHER PUBLICATIONS

Citation of Related U.S. Patents and/or Applications dated Mar. 2, 2018.

U.S. Patent and Trademark Office, Final Office Action issued in related U.S. Appl. No. 15/269,334 dated May 18, 2018.

U.S. Patent and Trademark Office, Non-Final Office Action issued in related U.S. Appl. No. 15/269,334 dated Apr. 10, 2019.

U.S. Patent and Trademark Office, Final Office Action issued in related U.S. Appl. No. 15/269,334 dated Sep. 11, 2019.

International Search Report and Written Opinion issued in Application No. PCT/CN2017/102124 dated Dec. 22, 2017.

International Search Report and Written Opinion issued in Application No. PCT/CN2017/102125 dated Dec. 22, 2017.

* cited by examiner

REFRIGERATOR WITH TARGETED COOLING ZONE

BACKGROUND

The present embodiments relate to a cooling zone integrated into a refrigerator appliance, and particularly, but not limited to, a cooling zone in a fresh-food compartment of a refrigerator.

Users often allow hot food and/or pans to cool before placement into refrigerators to reduce the likelihood of warming and/or spoiling of adjacent foods. However, this practice often may increase the likelihood of bacteria forming in the hot food and/or pans left at room temperature to cool. Room temperature cooling increases the time span that bacteria in the pans/object may more readily form, e.g., temperatures between about 40 degrees Fahrenheit and 140 degrees Fahrenheit. Thus, there is a need to rapidly cool objects, for example, such as food, beverages, and/or containers, etc., within a refrigerator to reduce the bacteria forming temperature time span, as well as simplify the user's interaction and identification of a targeted cooling zone therein.

SUMMARY

In some embodiments of the invention, for example, a refrigerator appliance includes a fresh-food compartment disposed within a housing. The fresh-food compartment may include a targeted cooling zone. The appliance may also include an outlet, a temperature sensor, a fan, and/or a controller. The outlet may be configured to direct cooling air to an object within the targeted cooling zone of the fresh-food compartment. The temperature sensor may be configured to sense at least a temperature of the object. The fan may be in fluid communication with the outlet and have a variable speed motor configured to adjust the flow rate of the cooling air. The controller may be coupled to the motor and the temperature sensor to dynamically vary the speed of the motor based upon at least the temperature value of the object sensed by the temperature sensor. In addition in some embodiments, the speed of the motor may decrease as the temperature of the object decreases towards a desired temperature value. The temperature sensor may be configured to sense the temperature of the object separate from a temperature of the fresh-food compartment. In some embodiments, the temperature sensor may be configured to sense the temperature of the object separate from a temperature of the fresh-food compartment. In addition in some embodiments, the temperature sensor may be in contact with the object and wirelessly coupled to the controller. In various embodiments, the desired temperature value may be different from the temperature of the fresh-food compartment.

In some embodiments, a weight sensor may be operatively coupled to the targeted cooling zone to sense the weight of the object. The appliance may also include in some embodiments a damper configured to direct cooling air towards the outlet, wherein the controller is coupled to the damper. Further in some embodiments, the controller may be configured to dynamically control the damper based upon temperature values sensed by the temperature sensor. In various embodiments, the appliance may include one or more identifying features adjacent the targeted cooling zone. In addition in some embodiments, an optical sensor may be operatively coupled to the targeted cooling zone to sense the volume of the object. Further in some embodiments, a sensor may be operatively coupled to the targeted cooling zone to sense at least one of a presence or absence of the object. Further, the sensor may be selected from a group consisting of weight, pressure, contact, optical, and IR sensors. In some embodiments, the controller may communicate a status to one or more network interfaces.

Other embodiments may include a method of operating a refrigerator appliance of the type including a fresh-food compartment within a housing and an air outlet configured to dispense cooling air towards a targeted cooling zone. The method may include initiating a cooling cycle by controlling the cooling air exiting the air outlet into the fresh-food compartment, sensing one or more temperature values associated with a targeted cooling zone with a temperature sensor, and dynamically operating a fan in fluid communication with the air outlet based upon the one or more temperature values, wherein output of the fan decreases as the one or more temperature values of the cooling zone decreases towards a desired temperature value.

In some embodiments, the method may further include a weight sensor and an optical sensor, and determining a cooling duration parameter for the targeted cooling zone based upon a weight value sensed by the weight sensor, a volume value sensed by the optical sensor, or the one or more temperature values. In various embodiments, the method may include determining a cooling duration parameter for the targeted cooling zone by comparing the one or more temperature values with a plurality of constants associated with temperature limit values. In addition in some embodiments, the step of sensing the one or more temperature values is performed before initiating the cooling cycle. Further in some embodiments, dynamically operating the fan includes controlling a flow rate associated with a flow rate value of the cooling air of the cooling cycle and determining the flow rate value based upon the one or more temperature values of the temperature sensor or a plurality of constants associated with temperature limit values. Further, the method of controlling the flow rate may include controlling a speed value of a motor of the fan. Further in some embodiments, the method of controlling the flow rate may include controlling a damper. In addition in some embodiments, the method of initiating the cooling cycle includes controlling a damper in fluid communication with the cooling air. Further, the method of sensing the one or more temperature values associated with the targeted cooling zone may use a temperature of an object within the targeted cooling zone. In various embodiments, the targeted cooling zone may be a portion of a fresh-food compartment.

In other embodiments, a refrigerator appliance may include a fresh-food compartment disposed within a housing. The fresh-food compartment may further include a targeted cooling zone. Further, the appliance may include an outlet configured to direct cooling air to an object within the targeted cooling zone of the fresh-food compartment. Further, the outlet may be in fluid communication with at least one of a fan and one or more dampers. Further in some embodiments, the appliance may include a temperature sensor configured to sense at least a temperature of the object. In addition in some embodiments, a controller may be coupled to the temperature sensor and at least one of the fan and the one or more dampers to dynamically vary the air flow rate of cooling air towards the cooling zone based upon the temperature value of the object sensed by the temperature sensor. The air flow rate may decrease as the temperature of the object decreases towards a desired temperature value.

In some embodiments, the fan may be a variable speed fan configured to adjust the air flow rate of the cooling air.

Further in some embodiments, the one or more dampers may control the air flow rate of the cooling air. In addition in some embodiments, the controller may communicate a status to one or more network interfaces. In various embodiments, the temperature sensor may be in contact with the object and may be wirelessly coupled to the controller. Further in some embodiments, a sensor may be operatively coupled to the controller to sense at least one of a presence or absence of the object.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques within a residential refrigerator appliance such as refrigerator appliance 10, such as the type that may be used in single-family or multi-family dwellings, or in other similar applications. However, it will be appreciated that the herein-described techniques may also be used in connection with other types of refrigerator appliances in some embodiments. For example, the herein-described techniques may be used in commercial applications in some embodiments. Moreover, the herein-described techniques may be used in connection with other refrigerator appliance configurations. Implementation of the herein-described techniques within french door refrigerators, bottom freezer refrigerators, top freezer refrigerators, wine refrigerators and beverage centers, compact refrigerators, etc. would be well within the abilities of one of ordinary skill in the art having the benefit of the instant disclosure, so the embodiments are not limited to the side-by-side refrigerator implementation discussed further herein.

Figure 1:
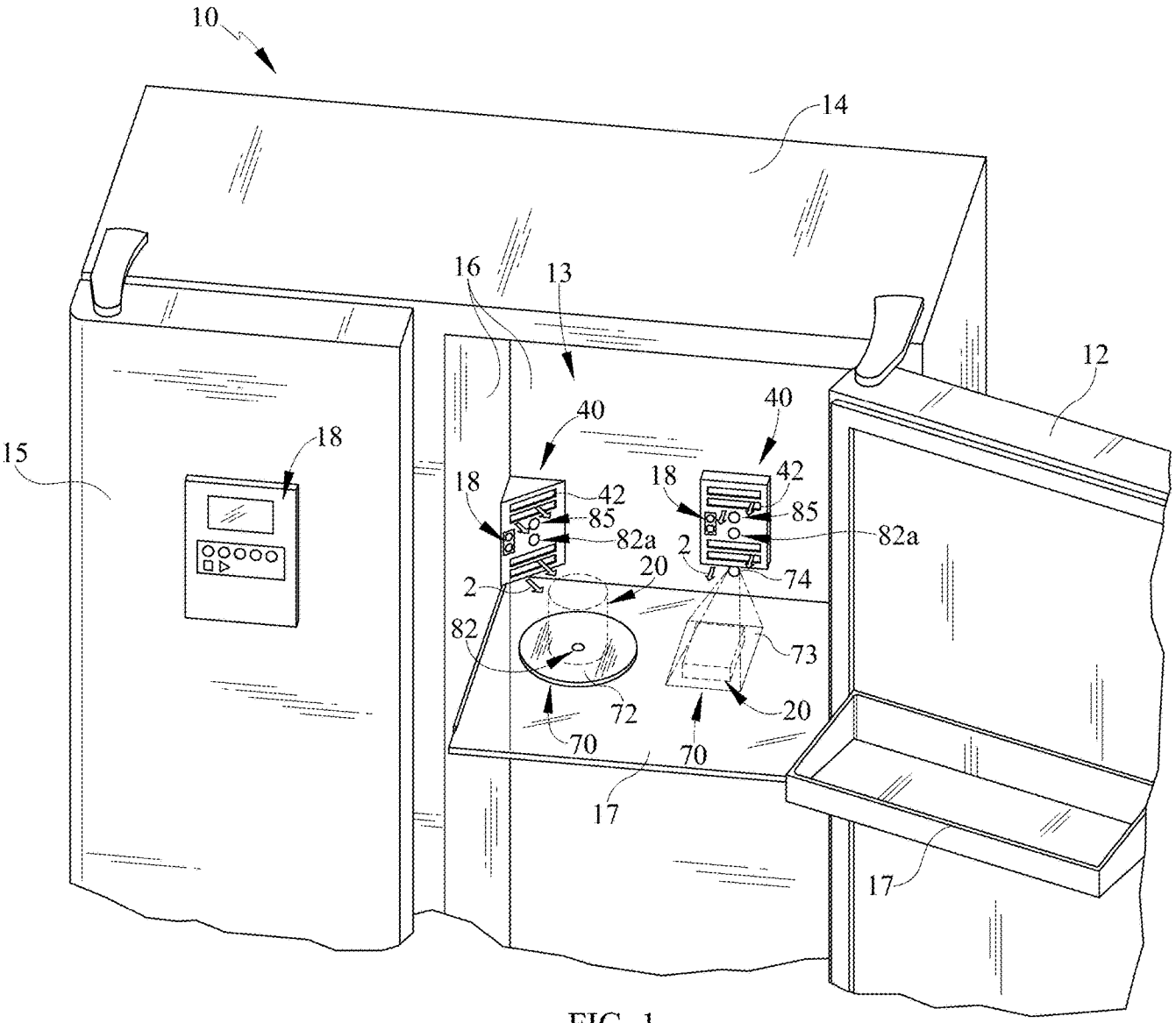
FIG. 1 is an enlarged perspective view of one embodiment of a fresh-food compartment of a refrigerator, with portions of the refrigerator broken away.

Turning now to the drawings, FIG. 1 illustrates an example refrigerator appliance 10 in which the various technologies and techniques described herein may be implemented. Refrigerator appliance 10 is depicted in this example as a side-by-side refrigerator, and as such includes front-mounted door 12 in a cabinet or housing 14 that provides access to the fresh-food compartment 13 housed within the cabinet or housing 14. Similarly an adjacent pivotable door 15 provides access to the freezer compartment (not shown) and when in the opened position, food and beverage items may be inserted into and removed from the freezer compartment. Door 12 is generally hinged along a side or top edge of the housing 14 and is pivotable between an open position illustrated in FIG. 1 and a closed position (not shown). When door 12 is in the opened position, food and beverage items, as well as the object 1 to be cooled in the cooling zone 20 (see FIG. 2), may be inserted into and removed from the fresh-food compartment 13 through the door 12 or, alternatively, through an opening in the door 12. Control over refrigerator appliance 10 by a user is generally managed through a control panel 18, which can be disposed on a door such as door 15 and/or 12. Control panel 18 can also be disposed with the fresh-food compartment 13 in another embodiment, or in both a door (12, 15) and the fresh-food compartment 13, and can be utilized with a user interface for the refrigerator appliance 10. It will be appreciated that in different refrigerator appliance designs, control panel 18 may include various types of input and/or output devices, including various knobs, buttons, lights, switches, textual and/or graphical displays, touch screens, etc. through which a user may configure one or more settings and start and/or stop a targeted cooling cycle, as described herein.

As shown in the Figures, a refrigerator appliance 10 may include a targeted cooling zone 20. A cooling air or air stream 2 from a variety of cooling sources 30 may be directed towards an object 1 within the refrigerator 10 to rapidly cool the object 1. Objects that may be cooled include, but are not limited to, hot pots/pans containing food, beverages, recently brewed tea, recently purchased groceries, food items in various stages of preparation or cooking, and the like. More specifically in some embodiments, the targeted cooling zone 20 may be positioned in the fresh-food compartment 13 of the refrigerator appliance 10. In some embodiments, a variety of identifying features 70 may be used to identify or assist the user in identifying the location of the targeted cooling zone 20, and to aid the user in placement of the object 1 to be cooled.

Figure 2:
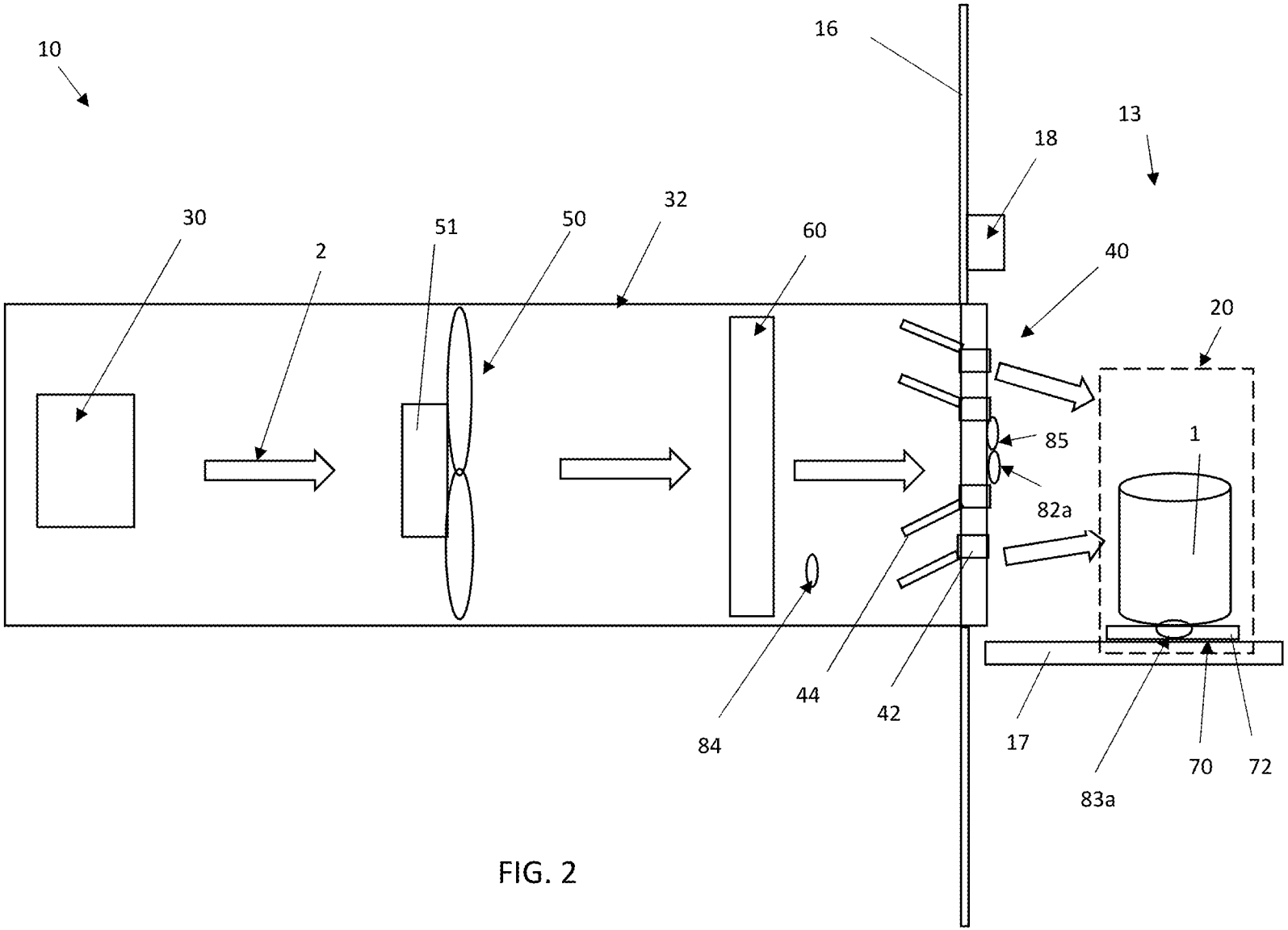
FIG. 2 is a schematic view of one embodiment of the cooling air flow towards the cooling zone.

In the one embodiments shown in FIGS. 1 and 2, the refrigerator appliance 10 includes one or more outlets 40 within the fresh-food compartment 13 adjacent the targeted cooling zone 20. The outlet 40 may include one or more openings or vents 42 therethrough, with or without directional vanes 44. The outlets 40 may be a variety of shapes, sizes, constructions, quantities, and positions relative to the targeted cooling zone 20. The outlet 40 is in fluid communication with one or more air flow channels 32 within the refrigerator appliance 10. One or more fan systems, e.g., including a fan 50 and an electric motor 51 and/or one or more dampers 60 may also be coupled to the one or more cooling sources 30 to dispense the cooling air stream 2 or flow from one or more outlets 40. However, it is also possible that no dampers 60 may be used with the fan system 50 in some embodiments. Further, it is also possible that no fan may be used with a damper 60 in some embodiments. For example, in some embodiments one or more outlets 40 may operate separately from another one or more outlets 40. Further, in some embodiments one or more fans 50 and/or one or more motors 51 may cause, force, induce, or exert a variety of different air flows between one or more of air flow channels 32 within the refrigerator appliance 10 in addition to the cooling air stream 2 directed to the targeted cooling zone 20. For example, the fan 50 may be a variable output or fixed speed fan. A cooling source 30 may be upstream of the air flow channel 32 and may be directly and/or indirectly connected to the air flow channel 32. One example of a cooling source 30 includes, but is not limited to, an evaporator, and it will be appreciated that the evaporator or other cooling source used for the cooling zone may, in some embodiments, be separate from other evaporators or cooling sources in the refrigerator (e.g., any evaporator or other cooling source used to cool the fresh-food compartment, the freezer compartment, and/or an ice maker). In other embodiments, however, the evaporator or other cooling source used to cool the cooling zone 20 may also be used to cool one or more of a fresh-food compartment, freezer compartment, and ice maker. In some embodiments, a cooling source may not be used. For example, a fan or the like may increase airflow and the associated convection coefficient, thereby increasing the rate of cooling in the zone.

As shown in the schematic of FIG. 2, a dedicated cooling source 30, fan 50, and/or damper 60 is in fluid communication with the outlet 40 separate from other cooling sources 30 within the refrigerator appliance 10. Alternatively, the air flow channel 32 and downstream air outlets 40 may be in fluid communication with the cooling source 30 that provides cooling air to the fresh-food compartment 13 and/or freezer compartments, such as before cooling air enters one or more of the compartments. Further, the air flow channel 32 to the outlets 40 may be downstream of and in fluid communication with the fresh-food compartment 13 and/or freezer compartment, for instance a fan 50 may pull cool air from the fresh-food compartment 13 instead of air directly from an evaporator. If used, the cooling sources 30 may be a variety of shapes, sizes, orientations, constructions, and quantities which may be used and still be within the scope of the teachings herein.

In the embodiment shown, the outlets 40 may be positioned in one or more walls 16 of the fresh-food compartment 13. The outlets 40 are positioned in proximity to cooling zone 20. The outlets 40 may be positioned above a shelf 17 and/or cooling zone 20. The shelf 17 or retention structure is able to receive the object 1 to be rapidly cooled within the targeted cooling zone 20 of the fresh-food compartment 13. The shelf 17 may be a variety of shapes, sizes, constructions, quantities, and positions relative to the fresh-food compartment 13, targeted cooling zone 20, and/or outlets 40. The shelf 17 and/or outlets 40 may be in a fixed position relative to each other. Alternatively, the shelf 17 and/or outlets 40 may be able to be moved relative to one another, separately, or together between a first position and a second position to allow for variances in object 1, such as size, shape, or desired orientation with respect to the cooling air stream 2 exiting the outlets 40. It should be understood that the outlets 40 and upstream air flow channels 32 may be included in a variety of structures of the refrigerator appliance 10. For example, one or more shelves 17 adjacent the targeted cooling zone 20 may incorporate portions of the air flow channel 32 and/or outlets 40. Further, in some embodiments the shelves 17, outlets 40, and/or air flow channels 32 may be positioned within the doors, such as, for example, door 12 to the fresh-food compartment 13.

One or more user interfaces of the control panel 18 may be used to operate the targeted cooling zone 20 by the user. One or more control panels 18 may be interior and/or exterior to the fresh-food compartment 13. For example as shown in FIGS. 1 and 2, a control panel 18 may be positioned in one of the doors 15, 12 and/or another control panel 18 may be adjacent one or more outlets 40 or shelves 17 to allow the user to operate the targeted cooling within the cooling zone 20.

As shown in FIGS. 1 and 2, the location of the targeted cooling zone 20 within the refrigerator appliance 10 may be indicated to the user by one or more identifying features 70. These identifying features 70 assist the user to position the object 1 for targeted or rapid cooling within the cooling zone 20. The term "features" is a general term to described structure, markings, etc. For example, it is to be understood that the identifying features may be a variety of shapes, sizes, orientations, constructions, and quantities which may be used and still be within the scope of the teachings herein. For example, the identifying feature 70 may have insulating or non-insulating properties to protect heat damage from the hot object. In addition, embodiments of identifying features 70 may include paint, lines, raised structure, a platform, a boundary ridge, a depression, labeling, etching, symbols, layers, colors, or patterns on the surface of the shelf, or the shelf, to indicate the cooling zone 20. By identifying the cooling zone 20 to the user with the identifying features 70, the user may easily locate the cooling zone 20 and place the object or objects 1 to be cooled into a predetermined position upon or within the features or structure. These identifying features 70 may reduce the likelihood of misalignment of the objects 1, and/or may improve the efficiency of cooling if the objects are properly placed. Further, placement of the object 1 into, onto, and/or out of the cooling zone 20 may activate and/or deactivate the process of cooling as described below. These identifying features 70 may be insulating and/or non-insulating structure. For example, the insulating structure may include a variety of heat insulating or resilient materials. The heat insulating structure may be formed of one or more materials such as, but not limited to, high-temperature silicone. The insulating structure may protect the shelf 17, such as if the shelf is made from glass, or other structure of the refrigerator appliance 10 from the heat dissipated from hot items or objects 1 placed into the cooling zone 20. It is also understood that the structure of the identifying features 70 may absorb heat from the object 1 to increase cooling of the object. A substantial portion of or the entire top surface of the shelf 17 may include identifying features 70. Alternatively, it should be understood that the identifying structure or features may illustrate non-cooling zones or positions not for the user to place the object to differentiate between zones of the shelf 17. For example, the perimeter of the cooling zone.

As shown in FIG. 1, one insulating embodiment of the identifying features 70 includes one or more heat insulating members 72. The heat insulating member 72 is in proximity to the outlet 40 and downstream of the outlet's cooling air stream 2. The heat insulating member 72 may be positioned below the outlets 40 with the openings 42 directing cooling air towards the cooling zone 20 and heat insulating members 72. The heat insulating member 72 is positioned on the shelf 17 as shown, but may alternatively be positioned on the door 12 or a shelf of the door of the fresh-food compartment 13. The heat insulating member 72 may be of a variety of shapes, sizes, and quantities, and is a disc-shaped heating pad that has a substantially planar top surface in the embodiment shown. Some embodiments may have a heat insulating member 72 that reflects or mimics or complements the pot or object's size or shape to be placed in the cooling zone 20. For example, in the embodiment shown the circular heat insulating member 72 may receive a round bottom pot. Other embodiments may be layered upon the shelf 17. The heat insulating member 72 may be fixed to the shelf 17 or other refrigerator structure; however, the heat insulating member 72 may also be removable from the shelf 17. For example, the heat insulating member 72 may be removed from the refrigerator appliance 10 in order to clean or replace the heat insulating member 72 and/or refrigerator structure previously attached thereto. Although the heat insulating member 72 shown is raised above the surround shelf at its periphery, one or more surfaces of the heat insulating member 72 pad may be recessed, raised, or flush with the remaining portion of the shelf 17 that may be outside or inside the member's periphery. Although not shown in the cooling zone 20, the heat insulting member 72 and/or shelf 17 may have one or more apertures therein. In some embodiments, the heat insulating member 72 may change appearance, such as color, during the cooling phase or cycle to represent the object's temperature to the user. In further embodiments, the heat insulating member 72 may allow air to circulate to one or more surfaces of the object 1. The heat insulating member 72 may include, or form by itself, or in combination with the shelf 17 or other structure, air channels to the bottom surface of the object 1 to increase the object's exposure to air or the cooling air stream 2. This may cool the object 1 and/or the heat insulating member 72 more rapidly. One example of the air channels created by the member 72 may be as a result of the top surface of heat insulating member having one or more grooves therein or possibly a plurality of members spaced from each other upon the top surface of the shelf to define air channels therebetween.

As shown in FIG. 1, one embodiment of the non-insulating identifying features 70 includes one or more illuminations 73 from one or more light sources 74. The light source 74 may be, but need not be limited to, one or more LEDs. The light source 74 may be disposed in a variety of positions in the fresh-food compartment 13 and still illuminate to identify the cooling zone 20 of the shelf 17. As is shown in the depicted embodiment, the light source 74 may be positioned above the shelf 17 within the compartment wall 16 and project one or more patterns of light or illuminations 73 on a portion of the shelf 17 to illustrate to the user where to place the object 1 to be rapidly cooled. Other embodiments utilizing illumination 73 may include lighting within the shelf 17 and/or below the shelf 17 to illuminate the location for object placement downstream of the outlets 40. In addition, the illumination 73 may be used to indicate to the user different stages of the cooling process as it relates to temperature of the object 1, or possibly the start and/or end of the cooling cycle, etc. Although the non-insulating identifying features 70 is shown in detail as illumination 73 from a light source 74 in the figures, it is merely representative of some embodiments, and it is to be understood that there are a variety of shapes, sizes, orientations, constructions, and quantities which may be used and still be within the scope of the teachings herein. For example, other embodiments of identifying features 70 that are non-insulating may include labeling, etching, symbols, layers, colors, or patterns on the surface of the shelf to differentiate the cooling zone of the shelf from the remaining portion of the shelf.

Further, to support automatic cooling at the targeted cooling zone consistent with the invention, refrigerator appliance 10 may also include at least a temperature sensor 82. A temperature sensor 82 may be used to generate a signal that varies with the temperature of object 1 in the cooling zone 20. In the illustrated embodiment, for example, a temperature sensor 82 may be implemented using an infrared (IR) sensor 82*a* (see FIGS. 1 and 2) targeted at the object 1 such that a temperature sensed by IR sensor 82*a* may vary as a function of time. It will be appreciated that a wide variety of temperature sensors 82 may be used to provide temperature sensing, including, optical sensors, wired or wireless contact sensors, and others. The temperature sensor 82 may be located in a variety positions within the fresh-food compartment 13 and still sense the temperature of the object 1. In some embodiments, the temperature sensor 82 may be included with or adjacent the identifying features 70, such as but not limited to the heat insulating member 72 as shown in FIG. 1, to be in contact with or close proximity to the object. Moreover in some embodiments, the temperature sensor may be wired or wirelessly coupled to the controller.

A weight sensor 83 may be used to generate a signal that varies based in part on the mass or weight of the contents and/or object 1. In the illustrated embodiment, for example, a weight sensor 83 may be implemented in refrigerator appliance 10 using one or more load cells 83*a* (see FIG. 2) that support object 1 on one or more corresponding shelves 17 and/or heat insulating members 72. Each load cell 83*a* may be an electro-mechanical sensor that outputs a signal that varies with a displacement based on load or weight, and thus outputs a signal that varies with the weight of the object 1. Multiple load cells 83*a* may be used in some embodiments, while in other embodiments, other types of transducers or sensors that generate a signal that varies with applied force, e.g., strain gauges, may be used. Furthermore, while load cells 83*a* are illustrated as supporting object 1, the load cells, or other appropriate transducers or sensors, may be positioned elsewhere in a refrigerator appliance 10 to generate one or more signals that vary in response to the weight of the object 1. Other types and/or locations of transducers suitable for generating a signal that varies with the weight or contact of the object to be cooled will be apparent to one of ordinary skill in the art having the benefit of the instant disclosure.

Additional sensors may also be incorporated into refrigerator appliance 10. For example as shown in FIGS. 1 and 2, in some embodiments, wired or wireless contact or weight sensors, an optical sensor 85, alone and/or other sensors, may be used to measure or estimate the volume of the object 1, or even to measure the presence or absence of an object 1. Further, in some embodiments, optical sensor 85 may also measure other characteristics of the object 1, e.g., temperature. In other embodiments, other sensors may be incorporated to measure additional object characteristics. In other embodiments, no optical sensor may be used.

In addition, in some embodiments, a flow sensor 84 such as one or more flowmeters may be used to sense an amount of cooling air flow dispensed into the cooling zone 20. In other embodiments, however, no flow sensor 84 is used. Instead, air outlet 40 may be configured with a static and regulated flow rate such that the amount of cooling air dispensed is a product of the flow rate and the amount of time the cooling air is dispensed. Therefore, in some embodiments, a timer may be used to determine the amount of cooling air dispensed into the targeted cooling zone 20. The duration may be preset, determined upon placing an object 1 in the targeted cooling zone 20, or predetermined.

Figure 3:
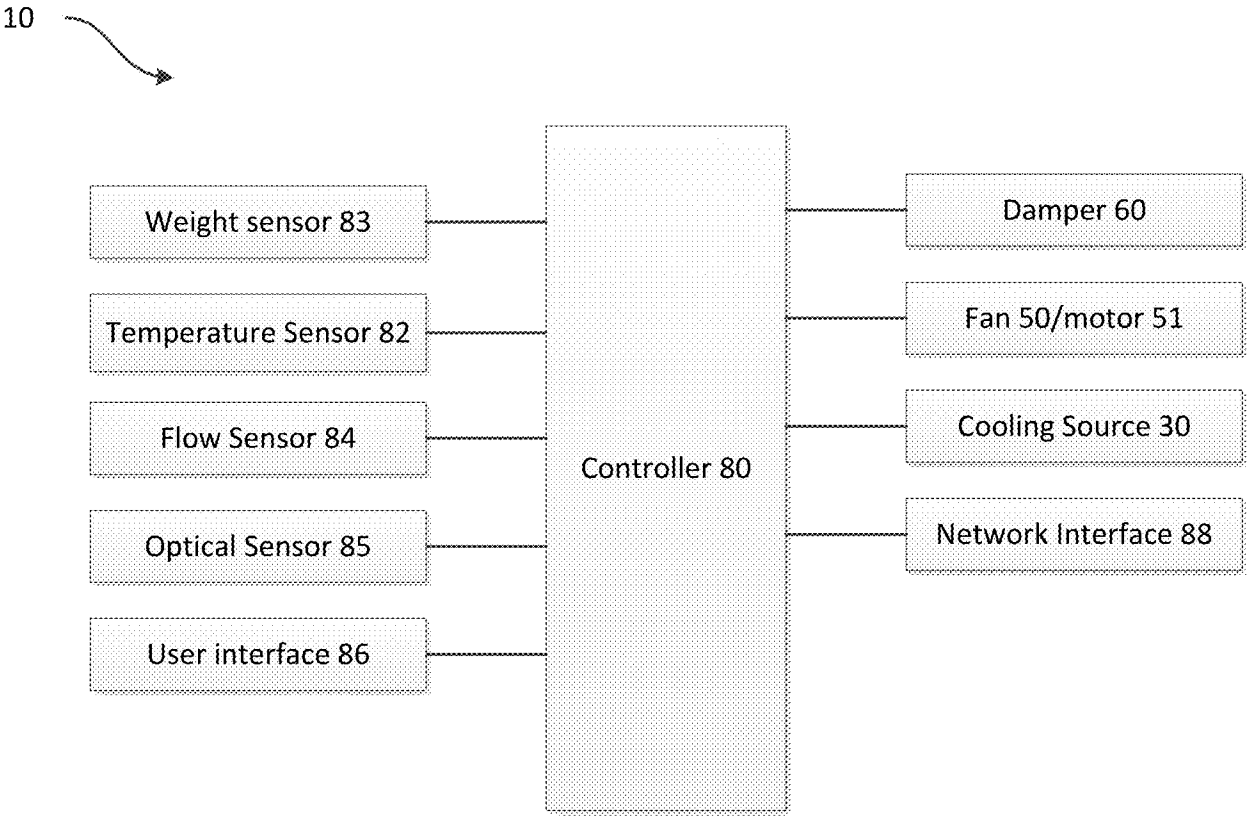
FIG. 3 is a block diagram of an example control system for the refrigerator appliance of FIG. 1.

Now turning to FIG. 3, refrigerator appliance 10 may be, in whole or in part, under the control of a controller 80 that receives inputs from a number of components and drives a number of components in response thereto. Controller 80 may, for example, include one or more processors and a memory (not shown) within which may be stored program code for execution by the one or more processors. The memory may be embedded in controller 80, but may also be considered to include volatile and/or non-volatile memories, cache memories, flash memories, programmable read-only memories, read-only memories, etc., as well as memory storage physically located elsewhere from controller 80, e.g., in a mass storage device or on a remote computer interfaced with controller 80.

As shown in FIG. 3, controller 80 may be interfaced with various components, including the aforementioned cooling source 30, fan 50, damper 60, temperature sensor 82, weight sensor 83, optical sensor 85, and flow sensor 84. In addition, controller 80 may be coupled to a user interface 86 including various input/output devices such as knobs, dials, sliders, switches, buttons, lights, textual and/or graphics displays, touch screen displays, speakers, image capture devices, microphones, etc. for receiving input from and communicating with a user, e.g., as may be disposed in a control panel 18. In some embodiments, controller 80 may also be coupled to one or more network interfaces 88, e.g., for interfacing with external devices via wired and/or wireless networks such as Ethernet, Bluetooth, NFC, cellular, and other suitable networks. Additional components may also be interfaced with controller 80, as will be appreciated by those of ordinary skill having the benefit of the instant disclosure. Moreover, in some embodiments, at least a portion of controller 80 may be implemented externally from a refrigerator appliance, e.g., within a mobile device, a cloud computing environment, etc., such that at least a portion of the functionality described herein is implemented within the portion of the controller 80 that is externally implemented.

In some embodiments, controller 80 may operate under the control of an operating system and may execute or otherwise rely upon various computer software applications, components, programs, objects, modules, data structures, etc. In addition, controller 80 may also incorporate hardware logic to implement some or all of the functionality disclosed herein. Further, in some embodiments, the sequences of operations performed by controller 80 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Figure 4:
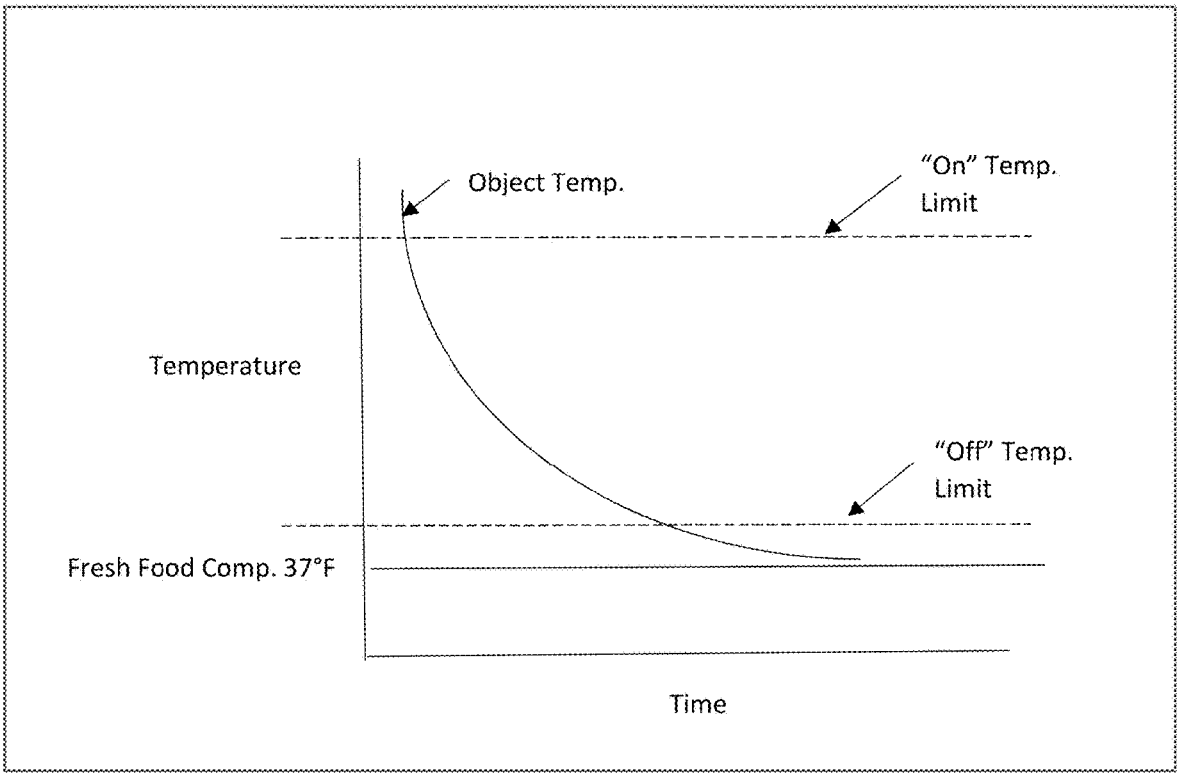
FIG. 4 is a chart illustrating temperature versus time and an embodiment of temperature limits to activate and/or deactivate the cooling cycle.
Figure 5:
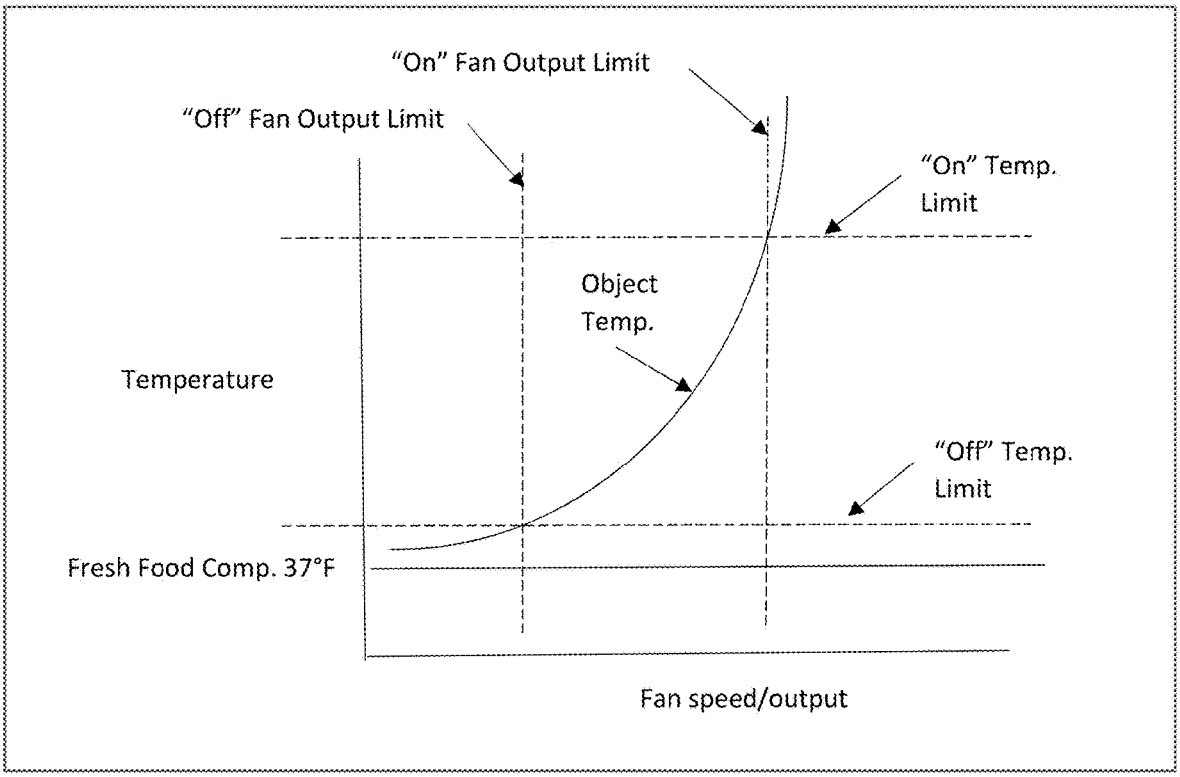
FIG. 5 is a chart illustrating temperature versus fan speed/output (rate of air flow) and an embodiment of limits during the cooling cycle.

With continuing reference to FIGS. 3-5, the duration of supplying targeted cooling air to the targeted cooling zone 20 may be manually and/or automatically started and/or ended by the refrigerator appliance 10. The user may manually start and/or end the cooling cycle to the targeted cooling zone 20. For example, an on and/or off switch may be used by the user to operate the cooling cycle. In other embodiments the cooling cycle may be automated. For example, the targeted cooling zone 20 may be cooled if a hot object 1 is detected by the temperature sensor 82, or other sensors, and will cool until the temperature decreases to a threshold or limit. For example, the mere presence of an object may start a cooling cycle and/or lack thereof may stop a cooling cycle.

It will be appreciated that the targeted cooling cycles can also vary in a number of respects. For example, a fixed or variable output/speed fan and/or motor 51 of the fan system, may be included. As shown in FIG. 5, in some embodiments, the fan 50 output or flow rate may be operatively controlled or adjusted based upon at least the temperature value such that the fan output decreases based on the decreasing temperature of the object 1. This dynamically controlled air output relative to the object temperature may be linear, nonlinear such as exponential, continuous, non-continuous, and/or combinations of the like. This dynamically controlled flow rate may reduce noise and energy consumption as the object 1 is progressively cooled towards the ambient or threshold temperature within the fresh-food compartment 13. For example, a variable speed motor may have a first speed at an object's first temperature and a second speed at an object's second temperature such that the motor operates at a higher first speed as a result of the high first temperature. Optionally, the fan output may decrease based on time. Similarly in embodiments where a damper is used, the cross-sectional opening of the damper may be variably controlled in response to the sensed temperature of the object 1 in the targeted cooling zone 20.

Each targeted cooling cycle or cooling phase may also have a number of different operational settings that may be varied for different types of objects to be cooled, e.g., different times or durations may be selected, e.g., known, preset, determined manually by a user, or predetermined by the user and/or sensor values. Further in some embodiments, different on and/or off temperatures may be selected, e.g., known, preset, determined manually by a user, or predetermined by user and/or sensor values during operation. In addition, different fan and/or motor speeds, such as single or variable, may be used. In some embodiments, various food mode selections such as preset duration and/or temperature limits dependent on object type. For example, hot pots from a stove can be set to 110° F. on/39° F. off, while beverages can be set to 50° F. on/40° F. off. Other object's limits may be added as needed or selected by the user and/or sensor values. In other embodiments, temperature limits or thresholds may be based on a fraction of fresh-food compartment temperature or based on a slope of temperature reduction may be used.

In particular, in some embodiments, a fan speed, motor speed, and/or damper position may be controlled based upon the sensed temperature of the object in the cooling zone. Thus, hotter objects will cause a greater amount of energy to be devoted to cooling than will cooler objects, and even for the same objects, the amount of energy may progressively be reduced as the objects cool to temperatures closer to that of the fresh-food compartment.

Figure 6:
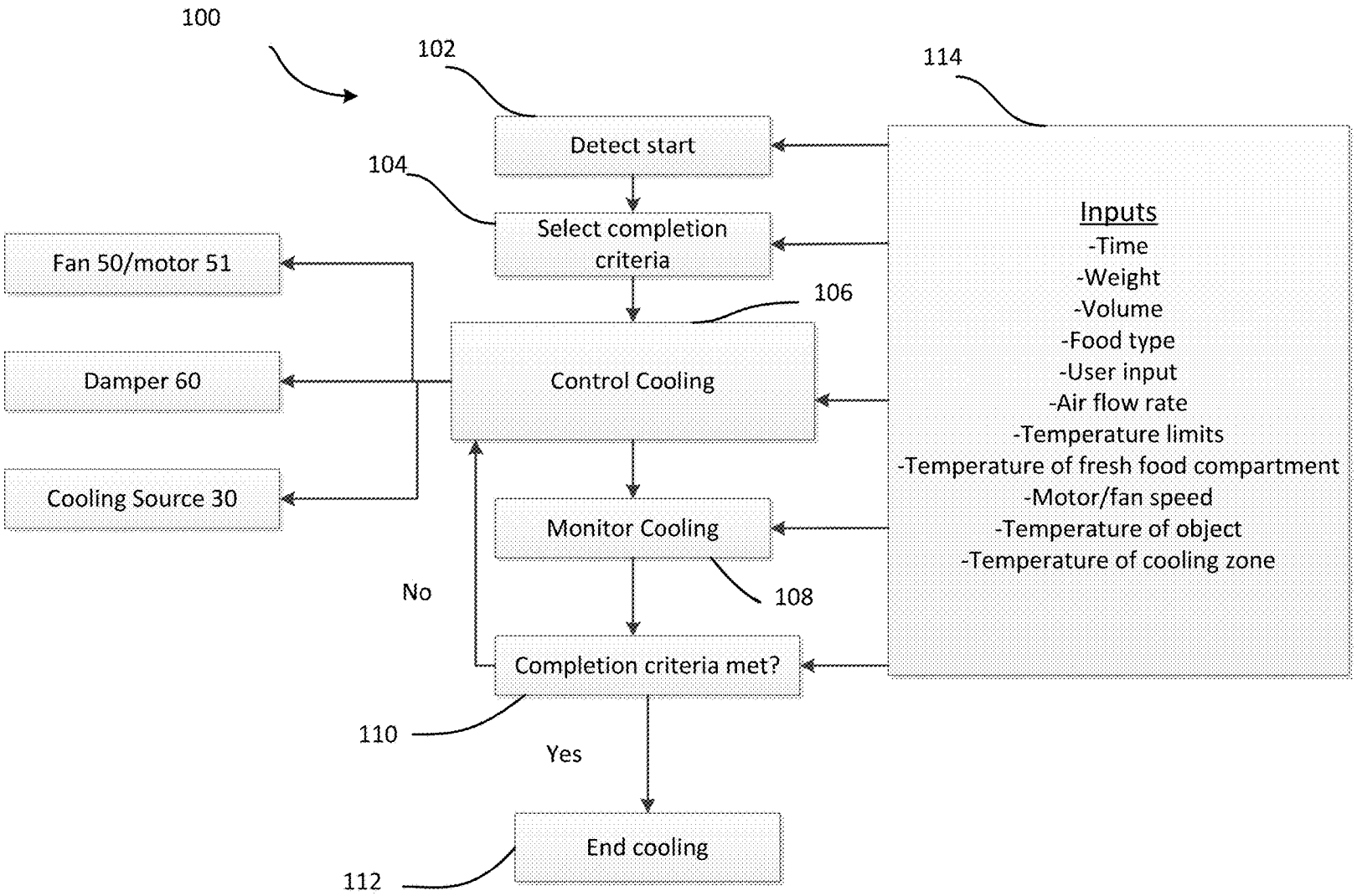
FIG. 6 is a flow chart illustrating an example sequence of operations of the cooling cycle or phase in the refrigerator appliance of FIG. 1.

Now turning to FIG. 6, and with continuing reference to FIGS. 1-5, a sequence of operations 100 for performing a cooling cycle or phase that cools a targeted cooling zone 20 and/or object 1 within the fresh-food compartment 13. Blocks 102-112 may determine the cycle criteria based upon a variety of outputs from the sensors and other inputs that are shown, by example only, in block 114. The cooling cycle may be started (block 102) in a variety of ways, e.g., pushing a button on the interior or exterior of the fresh-food compartment, detection with weight sensor or proximity sensor, detections via temperature sensing of the hot object, user interface, food type threshold limits, comparison of fresh-food compartment versus object temperature, voice commands, user gestures, etc. A loop in blocks 106-110 controls the cooling characteristics of the object and monitors the cooling, using, for example, sensor values and user inputs (block 114), etc., and correlating them with the selected, e.g., known, preset, manually determined, or predetermined, cooling completion criteria (block 104) and its completion status (block 110). For example, the monitoring may control the fan output of the fan 50 in relation to the object 1 temperature, such that the air flow rate decreases based on the monitored object's 1 decreasing temperature (see FIG. 5). The selected criteria may be based on the inputs, e.g., using any of the various manners discussed above, or in other manners that will be apparent to those of ordinary skill in the art having the benefit of the instant disclosure. Once the completion criteria (block 110) is met, the cooling cycle may then pass to block 112 to end the cooling cycle. Ending of the cycle (block 12) may include an indicator, alarm, message, text, visual and/or audio, or the like to make the user aware of the end of the cycle.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A refrigerator appliance comprising:

a fresh-food compartment disposed within a housing, wherein said fresh-food compartment includes a targeted cooling zone, and wherein said fresh-food compartment has a temperature;

an outlet disposed in said housing of said fresh-food compartment configured to direct cooling air to an object within said targeted cooling zone of said fresh-food compartment;

a temperature sensor configured to sense at least a temperature of the object, wherein said temperature sensor is an infrared sensor spaced from the object within said targeted cooling zone;

a fan in fluid communication with said outlet, said fan having a variable speed motor configured to adjust flow rate of the cooling air; and a controller coupled to said motor and said temperature sensor, said controller configured to dynamically vary the speed of said motor based upon at least said temperature value of the object sensed by said temperature sensor, wherein the speed of said motor decreases as the temperature of the object within said targeted cooling zone of said fresh-food compartment decreases towards an off temperature limit, wherein the off temperature limit is higher than the temperature of said fresh-food compartment, and wherein the speed of the motor is zero when the temperature of the object is at the off temperature limit.

2. The refrigerator appliance of claim 1 further comprising a weight sensor operatively coupled to said targeted cooling zone to sense the weight of the object.

3. The refrigerator appliance of claim 1 further comprising a damper configured to direct cooling air towards said outlet, wherein said controller is coupled to said damper, said controller configured to dynamically control said damper based upon temperature values sensed by said temperature sensor.

4. The refrigerator appliance of claim 1 further comprising an optical sensor operatively coupled to said targeted cooling zone to sense the volume of the object.

5. The refrigerator appliance of claim 1 further comprising a sensor operatively coupled to said targeted cooling zone to sense at least one of a presence or absence of the object.

6. The refrigerator appliance of claim 5 wherein said sensor is selected from a group consisting of weight, pressure, contact, optical, and IR sensors.

7. The refrigerator appliance of claim 1 further comprising one or more identifying features adjacent to said targeted cooling zone.

8. The refrigerator appliance of claim 1 wherein said temperature sensor is configured to sense the temperature of the object separate from a temperature of said fresh-food compartment.

9. The refrigerator appliance of claim 1 wherein said controller configured to communicate a status to one or more network interfaces.

10. A method of operating a refrigerator appliance of the type including a fresh-food compartment within a housing and an air outlet configured to dispense cooling air towards a targeted cooling zone, the method comprising:

initiating a cooling cycle by controlling the cooling air exiting said air outlet into said fresh-food compartment, wherein said targeted cooling zone is a portion of said fresh-food compartment;

sensing one or more temperature values associated with said targeted cooling zone with an infrared temperature sensor;

dynamically operating a fan in fluid communication with said air outlet based upon said one or more temperature values, wherein output of said fan decreases as said one or more temperature values of said targeted cooling zone decreases towards an off temperature limit, wherein the off temperature limit is higher than a temperature of the fresh-food compartment; and deactivating said cooling cycle when said one or more temperature values is at the off temperature limit, wherein deactivating said cooling cycle includes turning off said fan.

11. The method of claim 10, wherein the step of sensing said one or more temperature values is performed before initiating said cooling cycle.

12. The method of claim 10, wherein dynamically operating said fan includes:

controlling a flow rate associated with a flow rate value of the cooling air of said cooling cycle; and determining said flow rate value based upon said one or more temperature values of said temperature sensor or a plurality of constants associated with temperature limit values.

13. The method of claim 12, wherein controlling said flow rate includes controlling a speed value of a motor of said fan.

14. The method of claim 12, wherein controlling said flow rate includes controlling a damper.

15. The method of claim 10, wherein the step of initiating said cooling cycle includes controlling a damper in fluid communication with the cooling air.

16. The method of claim 10, wherein the step of sensing said one or more temperature values associated with said targeted cooling zone uses a temperature of an object within said targeted cooling zone.

17. A refrigerator appliance comprising:

a fresh-food compartment disposed within a housing, wherein said fresh-food compartment includes a targeted cooling zone;

an outlet configured to direct cooling air to an object within said targeted cooling zone of said fresh-food compartment, wherein said outlet is in fluid communication with at least one of a fan and one or more dampers;

an infrared temperature sensor configured to sense at least a temperature of the object within said targeted cooling zone of said fresh-food compartment, wherein said outlet includes said infrared temperature sensor; and a controller coupled to said temperature sensor and at least one of said fan and said one or more dampers configured to dynamically vary the air flow rate of cooling air towards said targeted cooling zone of said fresh food compartment based upon said temperature of the object sensed by said temperature sensor, wherein the air flow rate decreases as the temperature of the object decreases towards an off temperature limit, wherein the off temperature limit is higher than a temperature of said fresh-food compartment, and wherein the air flow rate of the cooling air is zero when the temperature of the object is at the off temperature limit.

18. The refrigerator appliance of claim 17 wherein said fan is a variable speed fan configured to adjust the air flow rate of the cooling air.

19. The refrigerator appliance of claim 17 wherein said one or more dampers control the air flow rate of the cooling air.

20. The refrigerator appliance of claim 17 wherein said controller configured to communicate a status to one or more network interfaces.

21. The refrigerator appliance of claim 17 further comprising a sensor operatively coupled to said controller to sense at least one of a presence or absence of the object.

* * * * *